US007207259B2

(12) United States Patent
Binetti Pozzi et al.

(10) Patent No.: US 7,207,259 B2
(45) Date of Patent: Apr. 24, 2007

(54) ACTUATOR FOR ACTUATING ONBOARD DEVICES ON A SAILBOAT

(75) Inventors: Francesco Binetti Pozzi, Verbania (IT); Alberto Lozza, Cornaredo (IT)

(73) Assignee: Harken Italy S.p.A., Lurago Marinone (CO) (IT)

( * ) Notice: Subject to any disclaimer, the term of this patent is extended or adjusted under 35 U.S.C. 154(b) by 3 days.

(21) Appl. No.: 11/156,777

(22) Filed: Jun. 20, 2005

(65) Prior Publication Data

US 2005/0284286 A1 Dec. 29, 2005

(30) Foreign Application Priority Data

Jun. 25, 2004 (IT) ..... MI2004A1296

(51) Int. Cl.
*F15B 15/00* (2006.01)
*B63H 9/00* (2006.01)

(52) U.S. Cl. ..... 91/4 R; 91/165

(58) Field of Classification Search ..... 91/4 R, 91/5, 165; 92/142
See application file for complete search history.

(56) References Cited

U.S. PATENT DOCUMENTS 1,812,533 A * 6/1931 Hunt ..... 91/4 R
2,490,823 A * 12/1949 Manning ..... 91/4 R
2,949,894 A * 8/1960 Hewitt ..... 91/4 R
4,207,803 A 6/1980 Gottling
5,411,321 A * 5/1995 Harness ..... 303/7

OTHER PUBLICATIONS

TOX Pressotechnik, Pneumatic-hydraulic unit type KT.

* cited by examiner

*Primary Examiner*—Thomas E. Lazo
(74) *Attorney, Agent, or Firm*—Pyle & Piontek

(57) ABSTRACT

An actuator (100) for actuating an onboard device (200) on a sailboat (300), comprises: a piston (2) slidably mounted within a cylinder (1) and movable between a first operating position, in which the piston is at a first end portion (3*a*) of the cylinder (1), and a second operating position, in which the piston is at a second end portion (3*b*) of the cylinder (1); hydraulic means (101, 15) for supplying a pressurised working fluid at the first end portion (3*a*) of the cylinder (1), this fluid being adapted to cause the piston (2) to move from the first operating position to the second operating position; pneumatic means for supplying (102, 11) a pressurised gas at the second end portion (3*b*) of the cylinder, this gas being adapted to cause the piston (2) to move from the second operating position to the first operating position.

6 Claims, 2 Drawing Sheets

ACTUATOR FOR ACTUATING ONBOARD DEVICES ON A SAILBOAT

The present invention refers to an actuator for actuating onboard devices on sailboats and to a cylinder for that actuator.

Throughout the present description and the following claims, with the term: onboard device, we mean any device on board a boat and intended to perform a function which is useful for the navigation and which requires the application of a set amount of force to make it function.

Among onboard devices of a sailboat there are some, e.g. the anchor-winch, the sliding keel, the jib furling system, the vang, the backstay, the winches, the device for opening the aft hatchways, the device for turning the anchor and the device for trimming the base of the mainsail, the actuation of which requires the application of a considerable force, which is often greater the larger the boat. For this purpose, wherever it is possible or acceptable, e.g. in the case of large cruiser sailboat, it is an established practice to use auxiliary power sources, e.g. hydraulic or pneumatic power sources, on board, which can, by means of suitable actuators, actuate the aforementioned onboard devices. First, the use of auxiliary power sources relieves the crew members of certain physically demanding manoeuvres, and second it makes it easier to simultaneously execute a number of onboard manoeuvres and/or onboard manoeuvres which have to be carried out at different places on the boat. This is particularly useful when a small crew is handling a big sailboat.

In particular, a typical onboard device actuating system of the hydraulic type on a sailboat comprises one or more hydraulic power sources, consisting, for example, of pumps adapted to put a working fluid, typically oil, under pressure, a hydraulic distribution system, and a number of actuators connected with the hydraulic distribution system and with the various onboard devices to be actuated. The actuators essentially consist of hydraulic cylinders which allow the pressure of the working fluid on the piston to be converted into a pushing and/or pulling force that can be used to actuate the onboard device.

In the field of sailboats it is known to use hydraulic cylinders in which the injection of the pressurised working fluid into a first portion of the cylinder results in the working stroke of the piston and of the rod associated thereto, while the backward stroke of the piston is caused by the expansion of a gas pre-loaded into a second portion of the cylinder and compressed each time the piston executes the working stroke.

In such cylinders there are drawbacks associated to the permanent presence of the compressible gas in the cylinder. First, the cylinders used have to be longer than the actual working stroke of the piston, because of the non-negligible volume filled by the gas when compressed. Second, there is a loss of useful work of the pressurised working fluid, since it has also to be partially done to compress the gas in the cylinder.

A constant need of the manufacturers of onboard devices for sailboats is to provide such devices with actuators which have size as reduced as possible and actuate the onboard devices with greatest possible efficiency. To meet this need, the Applicant has designed and manufactured an actuator for actuating onboard devices in sailboats, and a cylinder for that actuator, with improved features both in terms of their size and of the efficiency with which they actuate the onboard devices.

According to a first aspect thereof, the present invention concerns an actuator for actuating onboard devices on sailboats, comprising:

a piston slidably mounted within a cylinder and movable between a first operating position, in which the piston is at a first end portion of said cylinder, and a second operating position, in which said piston is at a second end portion of said cylinder;

hydraulic means for supplying a pressurised working fluid at said first end portion, said pressurised working fluid being adapted to cause said piston to move from said first operating position to said second operating position; characterised in that it comprises pneumatic means for supplying a pressurised gas at said second end portion, said pressurised gas being adapted to cause said piston to move from said second operating position to said first operating position.

According to the invention, through the aforementioned pneumatic means a gas at a suitable pressure is supplied at the second end portion of the cylinder whenever the piston is required to make the backward stroke from the second operating position to the first operating position. It is therefore possible to avoid using for this purpose a gas loaded in advance into the space in the cylinder between the second end portion thereof and the piston, and compressed during the working stroke of the piston. This provides advantages in terms of the size of the actuator and of the efficiency thereof. In fact, first it is possible to reduce the size of the cylinder, since there is no longer any need to provide a space for the compressed gas when the piston is in said second operating position; second, it is possible to convert all the work done on the piston by the pressurised working fluid (except for the losses inherent in the physics of the process), i.e. all the power generated by the onboard hydraulic power source of the boat, into useful force that the actuator can generate.

Use of the actuator of the invention requires that a pneumatic power source and a hydraulic power source are useful on board the boat. Some sailboats, in particular cruising sailboat, already have on board a hydraulic system and a pneumatic system adapted to respectively supply a pressurised fluid and gas for various uses; one or more actuators according to the invention can therefore easily be supplied through these systems. Where such systems are not present, they can be installed on board especially for the purpose, in conventional ways.

Preferably, the length of the cylinder from the-first end portion to the second end portion thereof is substantially equal to the working stroke of the piston within the cylinder plus the size of the piston, in order to advantageously obtain the greatest possible reduction of the size of the cylinder without compromising its performance.

In a preferred embodiment of the invention, the pneumatic means for supplying the pressurised gas comprises a supplying duct at the second end portion of the cylinder, the supplying duct comprising at the free end thereof a push-fit coupling for the connection to a pneumatic circuit distributing the pressurised gas. This makes the task of connecting the cylinder to the pressurised gas distribution circuit particularly simple and quick.

Preferably, the pressure of the gas fed under pressure into the cylinder of the actuator of the present invention is comprised between 5 bar and 100 bar, so as to ensure an adequate pushing force for the backward stroke of the piston without compromising the integrity of the cylinder and/or of the actuator.

More preferably, the pressure of said pressurised gas is comprised between 5 bar and 10 bar; these values allow advantageously an optimal operation of the actuator of the present invention.

According to second aspect thereof, the invention refers to a cylinder for an actuator for actuating onboard devices on a sailboard, comprising:

a piston slidably mounted within the cylinder and movable between a first operating position, in which said piston is at a first end portion of said cylinder, and a second operating position, in which said piston is at a second end portion of said cylinder;

a first supplying duct of a pressurised working fluid at said first end portion, said pressurised working fluid being adapted to cause the piston to move from said first operating position to said second operating position; characterised in that it comprises a second supplying duct of a pressurised gas at said second end portion, said pressurised gas being adapted to cause the piston to move from said second operating position to said first operating position.

This cylinder allow to obtain advantages similar to those described above with reference to the actuator in terms of reduced size and actuation efficiency of the onboard devices.

Preferably, the length of the cylinder from the first end portion and the second end portion thereof is substantially equal to the working stroke of the piston within the cylinder plus the size of the piston itself.

Preferably, the second supplying duct comprises at a free end thereof a push-fit coupling for the connection to a pneumatic circuit for distributing the pressurised gas into the cylinder.

Further characteristics and advantages of the invention shall become clearer from the following description of a preferred embodiment thereof, made hereafter for illustrating and not limiting purposes, with reference to the attached drawings. In these drawings.

Figure 1:
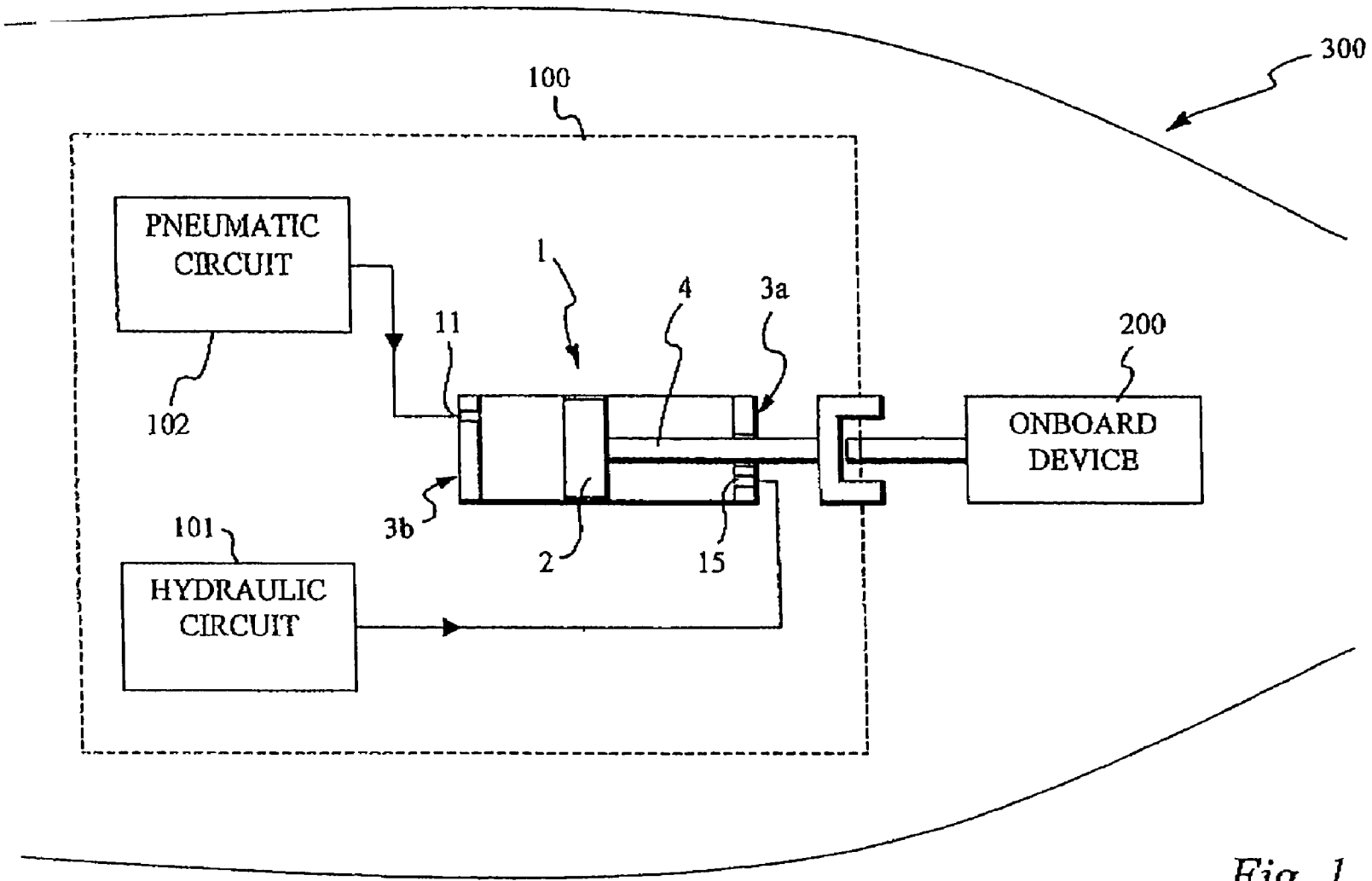
FIG. 1 is a schematic representation of an actuator according to the invention on board a sailing vessel.

FIG. 1 shows in schematic form an actuator 100 according to the present invention installed on board a sailboat 300. The actuator 100 actuates an onboard device 200, to which it is operatively connected in a conventional way. Examples, given for illustrating and not limiting purposes, of onboard devices 200 of the sailboat 300 which could be actuated by means of the actuator 100 are: the anchor-winch, the sliding keel, the jib furling system, the vang, the backstay, the winches, the device for opening the aft hatchways, the device for turning the anchor and the device for trimming the base of the mainsail.

The actuator 100 comprises a cylinder 1, a hydraulic circuit 101 and a pneumatic circuit 102, both in fluid connection with the cylinder 1. The hydraulic circuit 101 is adapted to supply a pressurised working fluid at a first end portion 3*a* of the cylinder 1, and is part of an essentially conventional onboard hydraulic system (not shown) comprising one or more hydraulic power-sources, e.g. a pump adapted to put a working fluid under pressure. The pneumatic circuit 102 is adapted to supply a pressurised gas at a second end portion 3*b* of the cylinder 1, and is part of an essentially conventional onboard pneumatic system (not shown) comprising at least one pneumatic power source, e.g. one or more bottles containing pressurised gas. The pressurised working fluid is preferably oil, and the pressurised gas is preferably compressed air.

Figure 3:
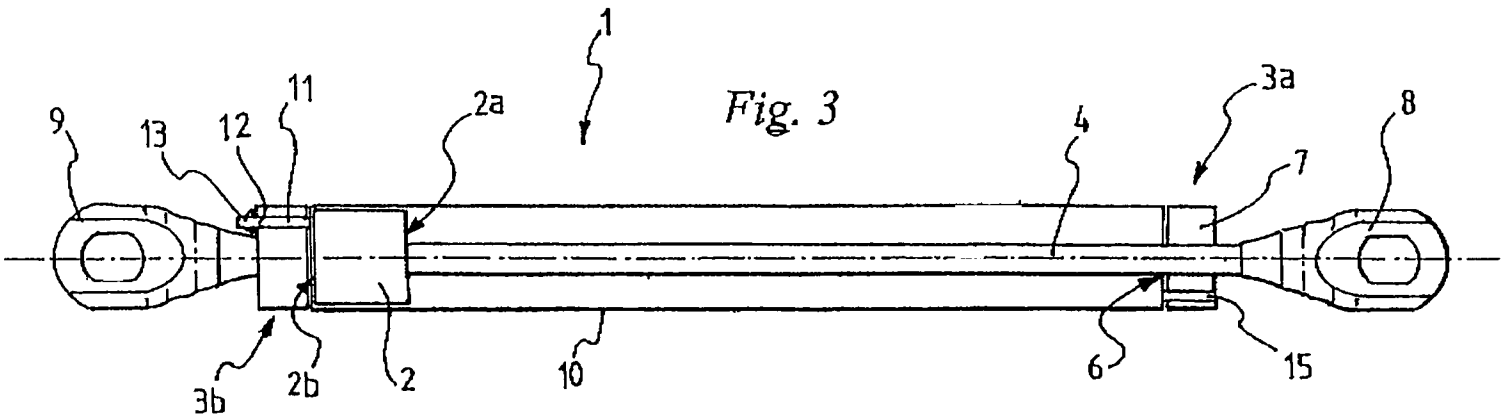
FIG. 3 is a schematic view of the cylinder of the actuator shown in FIG. 1.

FIG. 3 shows a cylinder 1, of the single-acting type, according to the present invention and suitable for use with the actuator 100. Within a cylinder body 10 a piston 2 is slidably mounted having a rod 4 attached thereto. The piston 2 is movable between a first operating position, in which the piston 2 is at the first end portion 3*a* of the cylinder 1 and the rod 4 substantially protrudes from the cylinder 1, and a second operating position, in which the piston 2 is at the second end portion 3*b* of the cylinder 1 and the rod 4 is substantially retracted into the cylinder 1. FIG. 3 specifically illustrates this second operating position of the piston 2.

A cylinder head 7 is removably associated to the cylinder 1 at the first end portion 3*a* thereof. The cylinder head 7 has a slide seat 6 for the free end of the rod 4.

At the inside surface of the slide seat 6, in contact with the surface of the rod 4, conventional guiding and/or centring elements and seals are provided (not shown), typically made of some elastomeric material. Similar guiding and/or centring components and seals are conventionally provided (not shown) on the outer surface of the piston 2, so as to come into contact with the inside wall of the cylinder body 10.

Mechanical coupling means, e.g. a fork element 8, is fixedly associated with the free end of the rod 4, which protrudes outside the cylinder 1, and allows mechanical connection of the rod 4 with the onboard device 200 to be actuated (see FIG. 1). Mechanical coupling means, e.g. a fork element 9 is likewise provided at the second end 3*b* of the cylinder 1, to fasten the cylinder 1 to the sailboat 300.

A first supplying duct 15 of the pressurised working fluid is provided at the first free end portion 3*a* of the cylinder 1. According to the invention, a second supplying duct 11 of the pressurised gas is provided at the second end portion 3*b* of the cylinder 1, and a free end 12 thereof has a push-fit coupling 13 for the connection to the pneumatic circuit 102 (see FIGS. 1 and 2).

In the embodiment shown in FIG. 3, and with the supplying ducts 15 and 11 arranged as described above, the cylinder 1 can produce a pulling actuating force. In an alternative embodiment of the invention (not illustrated) the position of the ducts 11 and 15 could be reversed, so that the supplying duct 15 of the working fluid is provided at the end portion 3*b* of the cylinder 1 and the supplying duct 11 of the pressurised gas is provided at the end portion 3*a* of the cylinder 1, in such a way that the cylinder 1 would then produce a pushing actuating force.

The functioning of the actuator 100 and of the cylinder 1 will now be described, with reference to FIGS. 1 and 3. An initial operating configuration wherein the piston 2 of the cylinder 1 is in its first operating position, at the first end portion 3*a* of the cylinder 1, and almost all of the rod 4 protrudes from the cylinder 1, is assumed. The working fluid in the hydraulic circuit, typically oil, is supplied to the cylinder 1 at the aforementioned first end portion 3*a* through the first supplying duct 15 at a set pressure which depends on the actuating force required. The pressure of the working fluid on a first face 2*a* of the piston 2 causes that piston to move towards its second operating position, at the second end portion 3*b* of the cylinder 1. This is how the working stroke of the piston 2 is made, during which the desired actuating force (in this case a pulling force) is applied to the onboard device 200 connected to the piston 2 by means of the rod 4 and the mechanical coupling means 8.

According to the invention and as shown in FIG. 3, the length of the cylinder 1 from the first end portion 3*a* to the second end portion 3*b* is substantially equal to the working stroke of the piston 2 plus the size of the piston itself.

When it is desired to return the piston 2 to the initial position, a pressurised gas, preferably compressed air, is supplied to the cylinder 1 at the second end portion 3*b* by means of the second supplying duct 11. The pressure of the pressurised gas on a second face 2*b* of the piston 2 causes the return stroke of the piston towards its first operating position, at the first end portion 3*a*. At this point the supply of pressurised gas to the cylinder is interrupted by means of conventional interception device (not shown), and the actuator 100 is again ready to actuate the onboard device 200. The pressurised gas is stored in suitable tanks or bottles (not shown) connected to the pneumatic circuit 102, preferably at a pressure of 200 bar. This pressure is then reduced in a conventional way to the working pressure, preferably between 5 bar and 100 bar, and more preferably between 5 bar and 10 bar, this being the range within the actuator 100 works best.

The functioning of the actuator 100 can be reversed where a pushing actuating force is required, by supplying the working fluid to the second end portion 3*b* of the cylinder 1 and the pressurised gas to the first end portion 3*a*, as described above.

In the following examples the results of some experimental tests done by the Applicant in order to show the improved performance of the actuator and cylinder according to the present invention compared to the actuators equipped with conventional hydraulic cylinders.

EXAMPLES

In a first test an actuator equipped with a cylinder according to the invention was used, having a 30 mm bore and a 300 mm working stroke of.

The gas for the return stroke of the piston from the second operating position to the first operating position was supplied to the cylinder at a pressure of 10 bar. The length of the cylinder from the first end portion to the second end portion thereof was substantially equal to the working stroke of the piston plus the size of the piston, and the overall size was about 509 mm. The oil pressure was 700 bar and the useful force Fu for actuating the onboard device was equal to the force $F_{oil}$ exerted on the piston by the oil pressure:

$$F_u=F_{oil}=43960\text{N}$$

Figure 2:
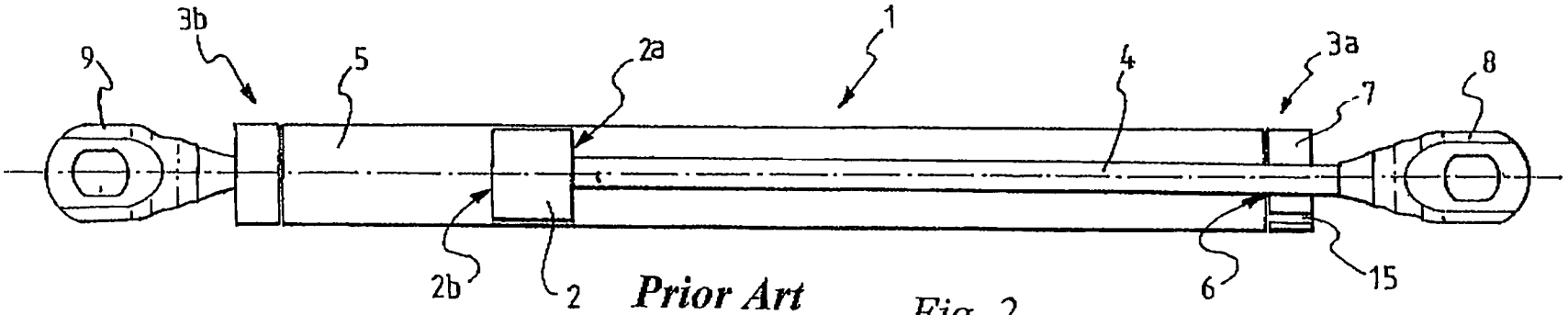
Prior Art Fig. 2
FIG. 2 is a schematic view of a hydraulic cylinder of the prior art.

In a second test an actuator equipped with a hydraulic cylinder of the known type was used, also having a 30 mm bore and a 300 mm working stroke, such as that shown in FIG. 2. In this Figure, elements structurally or functionally equivalent to those of the cylinder of the present invention, shown in FIG. 3, have been marked with the same numerals.

In this case, the gas for the piston's return stroke 2 was pre-loaded before use into the cylinder 1. The gas was loaded in such a way that, when the piston 2 was in its first operating position, the initial pressure within the cylinder 1 was 10 bar. When the piston 2 was in its second operating position, at the end of the working, stroke, the gas filled a volume 5 within the cylinder 1, determined with the constraint that the final pressure should not exceed 50 bar. Assuming an initial gas pressure of 10 bar and a working stroke of the piston 2 of 300 mm, the design of the cylinder 1 that would ensure that the volume 5 was of sufficient to satisfy the abovementioned constraint required that the cylinder 1 was about 75 mm longer than the length of the working stroke of the piston 2 plus the size of the piston itself. The overall size of the cylinder 1 was accordingly about 592 mm. The pressure of the oil supplied was 700 bar and the useful force $F_u$ for actuating the onboard device was:

$$F_u=F_{oil}-F_{gas}=43960N-3532.5N=40427.5N$$

where $F_{oil}$ is the force generated on the piston 2 by the oil pressure and $F_{gas}$ is the force used to compress the gas in the cylinder 1 from 10 bar to 50 bar.

The main parameters and results of the tests described above are summarised in Table 1 below.

TABLE 1

| TEST | Bore (mm) | Working stroke (mm) | Overall size (mm) | $F_u$ (N) |
|---|---|---|---|---|
| 1 (Invention) | 30 | 300 | 509 | 43960 |
| 2 (Prior art) | 30 | 300 | 592 | 40427 |

A comparison of these figures clearly shows that the use of the actuator and cylinder of the present invention allows to considerably reduce the size and to increase the useful force for actuating onboard devices, compared with actuators equipped with cylinders of the prior art.

The invention claimed is:

1. Sailboat onboard actuating system, comprising:

an actuator (100 comprising:

a piston (2) slidably mounted within a cylinder (1) and movable between a first operating position, in which said piston (2) is at a first end portion (3*a*) of said cylinder (1), and a second operating position, in which said piston (2) is at a second end portion (3*b*) of said cylinder (1);

hydraulic means (101, 15) for supplying a pressurised working fluid at said first end portion (3*a*), said pressurised working fluid being adapted to cause said piston (2) to move from said first operating position to said second operating position;

pneumatic means (102, 11, 13) for supplying a pressurised gas at said second end portion (3*b*), said pressurised gas being adapted to cause the piston (2) to move from said second operating position to said first operating position; and an onboard device (200) actuatable by said actuator (100).

2. Sailboat onboard actuating system according to claim 1, wherein the length of said cylinder (1) from said first end portion (3*a*) to said second end portion (3*b*) is substantially equal to the working stroke of said piston (2) within said cylinder (1), plus the size of said piston (2).

3. Sailboat onboard actuating system according to claim 1, wherein said pneumatic means (102, 11, 13) for supplying said pressurised gas comprises a supplying duct (11) at said second end portion (3b) of said cylinder (1) and wherein said supplying duct (11) has at a free end thereof (12) a push-fit coupling (13) for the connection to a pneumatic circuit (101) distributing said pressurised gas.

4. Sailboat onboard actuating system according to claim 1, wherein the pressure of said pressurised gas is comprised between 5 bar and 100 bar.

5. Sailboat onboard actuating system according to claim 4, wherein the pressure of said pressurised gas is comprised between 5 bar and 10 bar.

6. Sailboat onboard actuating system according to claim 1, wherein said onboard device (200) is selected from the group comprising: the anchor winch, the sliding keel, the jib furling system, the yang, the backstay, the winches, the device for opening the aft hatchways, the device for turning the anchor, the device for trimming the base of the mainsail.

* * * * *